US005154059A

United States Patent [19]

Keller

[11] Patent Number: 5,154,059

[45] Date of Patent: Oct. 13, 1992

[54] COMBUSTION CHAMBER OF A GAS TURBINE

[75] Inventor: Jakob Keller, Dottikon, Switzerland

[73] Assignee: Asea Brown Boveri Ltd., Baden, Switzerland

[21] Appl. No.: 851,125

[22] Filed: Mar. 16, 1992

Related U.S. Application Data

[63] Continuation of Ser. No. 523,888, May 16, 1990, abandoned.

[30] Foreign Application Priority Data

Jun. 6, 1989 [CH] Switzerland ..... 2099/89

[51] Int. Cl.[5] ..... F23R 3/46; F23R 3/30

[52] U.S. Cl. ..... 60/737; 60/747

[58] Field of Search ..... 60/737, 739, 743, 748, 60/746, 747, 755; 431/173, 284

[56] References Cited

U.S. PATENT DOCUMENTS 3,512,359 5/1970 Pierce .
3,834,159 9/1974 Vdoviak ..... 60/746
4,194,358 3/1980 Stenger ..... 60/39.826
4,781,030 11/1988 Hellat et al. ..... 60/743
4,932,861 6/1990 Keller et al. ..... 431/173

FOREIGN PATENT DOCUMENTS 944310 4/1949 France .

*Primary Examiner*—Louis J. Casaregola
*Assistant Examiner*—Timothy S. Thorpe
*Attorney, Agent, or Firm*—Burns, Doane, Swecker & Mathis

[57] ABSTRACT

In a combustion chamber (A) of the form of an annular combustion chamber, a row of large and small premixed burners (B, C) are arranged along the annular front wall (10). The large premixed burners (B), which are the main burners of the combustion chamber (A), and the small premixed burners (C), which are the pilot burners of the combustion chamber (A), follow each other alternately and regularly along the front wall (10) where they also emerge into the combustion space of the combustion chamber (A). A plurality of air nozzles (D), whose injection is directed into the combustion space of the combustion chamber (A), are placed between the large premixed burners (B) and the small premixed burners (C).

10 Claims, 5 Drawing Sheets

COMBUSTION CHAMBER OF A GAS TURBINE

This application is a continuation of application Ser. No. 07/523,888, filed May 16, 1990 now abandoned.

BACKGROUND OF THE INVENTION

1. Field of the Invention

The present invention concerns a combustion chamber as described in the preamble of claim 1.

2. Discussion of Background

In view of the extremely low $NO_x$ emissions specified for gas turbine operation, many manufacturers are converting to the use of premixed burners. One of the disadvantages of premixed burners is that they go out even at very low excess air numbers (ratio of the actual air/fuel ratio to the stoichiometric air/fuel ratio), this occurring at a $\lambda$ of about 2, depending on the temperature after the gas turbine compressor. For this reason, such premixed burners must be supported by one or more pilot burners in part-load operation of a gas turbine. Generally speaking, diffusion burners are used for this purpose. Although this technique permits very low $NO_x$ emissions in the full-load range, the auxiliary burner system leads to substantially higher $NO_x$ emissions at part-load operation. The attempt, which has become known on various occasions, to operate the auxiliary diffusion burners with a weaker mixture or to use smaller auxiliary burners must fail because the burn-out deteriorates and the $CO/C_xH_4$ emissions increase very sharply. In the language of the specialist, this state of affairs has become known as the $CO/C_xH_4$—$NO_x$ dilemma.

SUMMARY OF THE INVENTION

Accordingly, one object of this invention is to provide a novel combustion chamber which permits a wide operating range with minimized exhaust gas emissions while optimizing the quality factor for the temperature profile at the turbine inlet, known among specialists as the "pattern factor".

For this purpose, a large and a small premixed burner are placed alternately along the whole of the front wall of the combustion chamber, i.e. there is a small premixed burner located between each two large premixed burners. In addition, air nozzles are provided in each case between a large and a small premixed burner and these air nozzles introduce a certain proportion of air into the combustion space. This is an optimum configuration for an annular combustion chamber, the front wall being then correspondingly annular.

The large premixed burners, referred to in what follows as the main burners, have a size relationship (in terms of the burner air flowing through them) relative to the small premixed burners, referred to in what follows as the pilot burners, which is determined from case to case. The pilot burners operate as independent premixed burners over the whole of the load range of the combustion chamber, the excess air number remaining almost constant. Because the pilot burners can now be operated over the whole of the load range with an ideal mixture (premixed burners), the $NO_x$ emissions are very low even at part load. It is also found that in the interests of an improvement potential for gas turbines with higher inlet turbine temperatures, the air proportion which cannot be carried via the burners (stability limit, $CO/C_xH_4$) should not, because of the pattern factor, be used exclusively for cooling purposes. By means of the air nozzles provided in the present specification, a certain proportion of air is preferably introduced after the primary combustion zone of the combustion space and care is taken to ensure that perfect mixing takes place there. This has the advantage that the air proportion which guarantees improvement and which, in consequence, is blown directly into the secondary combustion zone, prevents the undesirable "thinning" of the primary zone. Because the air nozzles are located at a position with very small air velocity and, in any case, only take up a very limited width of the front wall, their influence on the main flow field in the primary zone is only a very weak one. In particular, the air nozzles do not lead to any adverse effect on the transverse ignition between the smaller burners (pilot burners) and the larger burners (main burners). A further advantage of these air nozzles arises due to their position on the front wall; this zone would become very hot there without the cooling effect of the air nozzles. The main advantage of these air nozzles may therefore be seen in the fact that the shear layers occurring between the main burners and the pilot burners are stabilized. For this reason, the stability limit of the combustion chamber, at which only the pilot burners operate independently, is improved decisively by the air nozzles.

An advantageous embodiment of the invention is then achieved if the main burners and the pilot burners consist of different sizes of so-called double-cone burners and if the latter are integrated into an annular combustion chamber. Because the circulating streamlines in the annular combustion chamber in such a constellation come very close to the vortex centers of the pilot burners, ignition is possible by means of these pilot burners only. During run-up, the particular fuel quantity supplied via the pilot burners is increased gradually until these pilot burners produce the full operating output. The configuration is selected in such a way that this point corresponds to the load rejection condition of the gas turbine. The further increase in output then takes place by means of the main burners. At the peak load of the plant, the main burners are also fully in operation. Because the configuration of "small" hot vortex centers (pilot burners) between large cooler vortex centers (main burners) is extremely unstable, very good burn-out with low $CO/C_xH_4$ emissions is also obtained when the main burners are run very weak in the part-load range, i.e. the hot vortices of the pilot burners penetrate immediately into the cold vortices of the main burners.

Advantageous and desirable extensions of the way in which the object is achieved according to the invention are described in the further dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
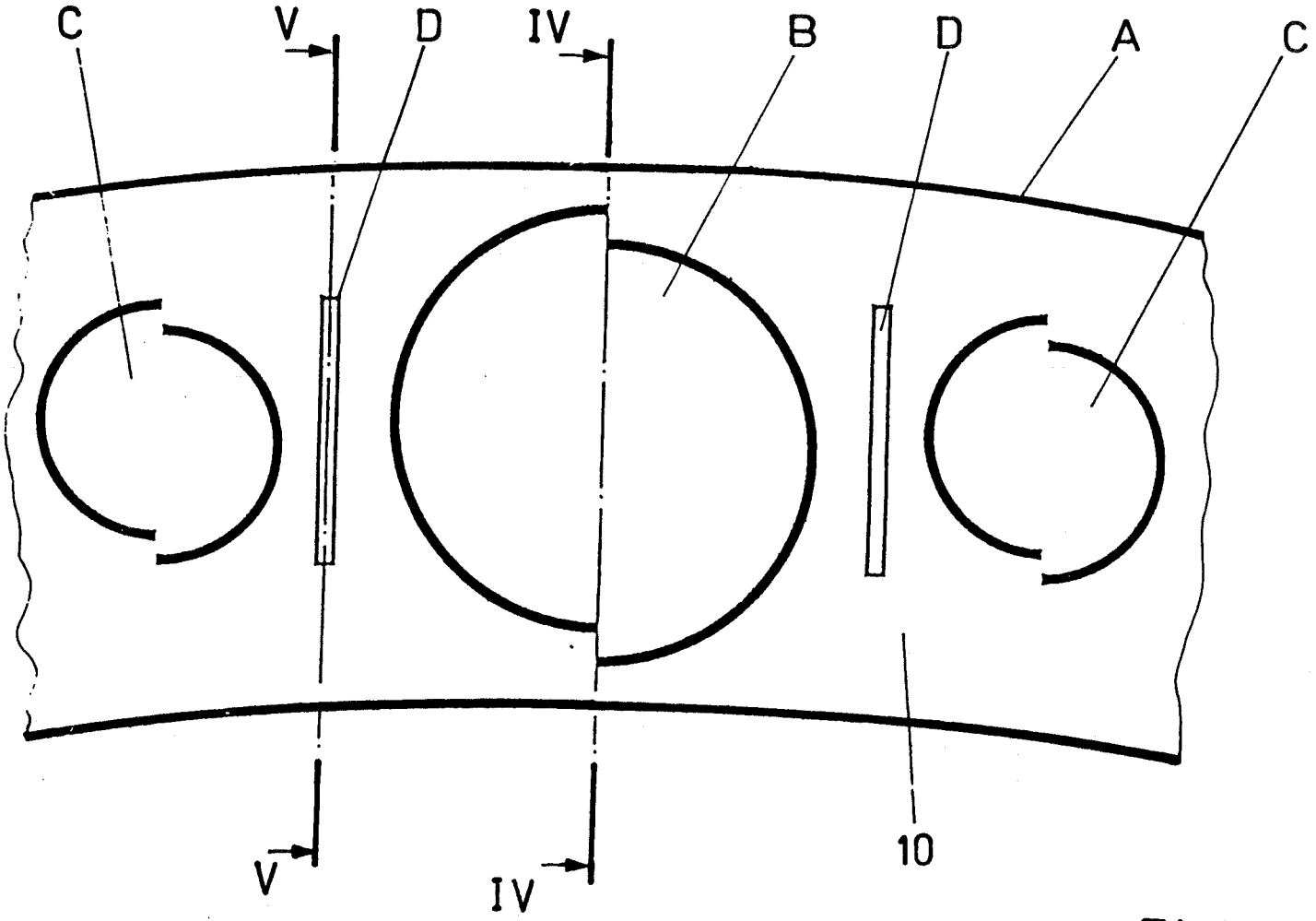
FIG. 1 shows a diagrammatic view onto a part of the front wall of an annular combustion chamber, with similarly diagrammatically represented primary burners, main burners and air nozzles.

Referring now to the drawings, wherein like reference numerals and letters designate identical or corresponding parts throughout the several views, wherein all the elements not necessary for immediate understanding of the invention are omitted and wherein the flow direction of the media is indicated by arrows, FIG. 1 shows an excerpt from a sector of the front wall 10. The placing of the individual main burners B and pilot burners C can be seen. These burners are evenly and alternately distributed on the periphery of the annular combustion chamber A. The size difference shown between the main burners B and the pilot burners C is of qualitative nature only. The effective size of the individual burners and their distribution and number on the periphery of the front wall 10 of the annular combustion chamber A depends, as already described, on the output and size of the combustion chamber itself. The main burners B and pilot burners C, which are arranged alternately, all emerge at the same height in a uniform annular front wall 10, which forms the inlet surface of the annular combustion chamber A. A number of air injection conduits D, here shown diagrammatically, are provided in each case between the individual burners B, C and take up approximately half the width of the front wall 10 in the radial direction. If the main burners B and pilot burners C generate vortices in the same direction, a peripheral flow enclosing the burners B and C occurs above and below these burners. As an explanation of this condition, reference is made to an endless conveyor belt as a comparison, this belt being kept in motion by rollers turning in the same direction. The role of the rollers is in this case undertaken by vortex-generating burners operating in the same direction. In addition, the various burners form vortex center occurs around the particular burner; the vortex centers around the pilot burners C are small and hot and intrinsically unstable. These come to rest between the large, cooler vortex centers originating from the main burners B. The air injected through the conduits D acts in this zone between the small hot and large cooler vortex centers and decisively improve the stabilization of both, as has already been assessed above. Even if the main burners B are operated thin, as occurs during part-load operation, very good burn-out with low $CO/C_xH_4$ emissions can be expected.

Figure 2:
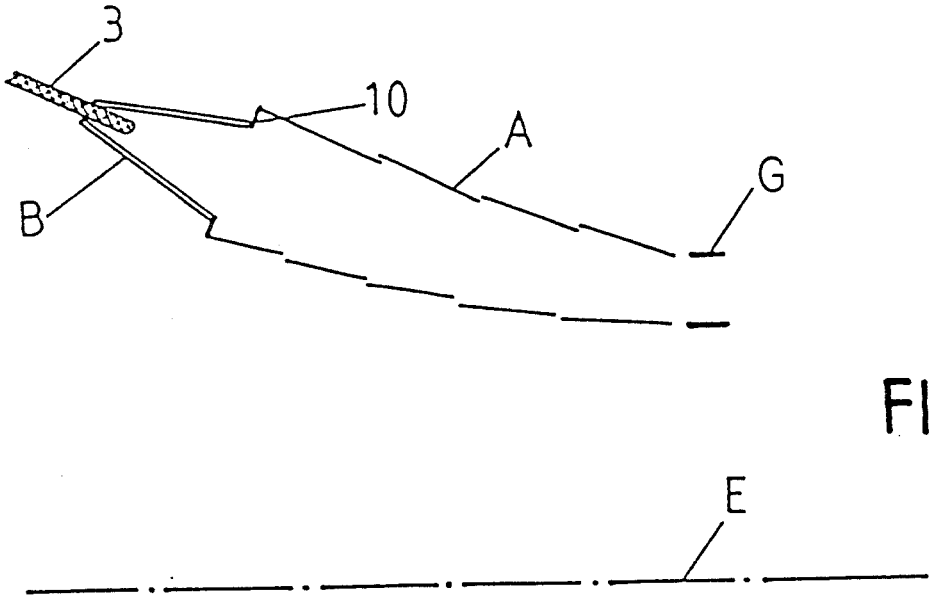
FIG. 2 shows a diagrammatic section through an annular combustion chamber in the plane of a main burner.
Figure 3:
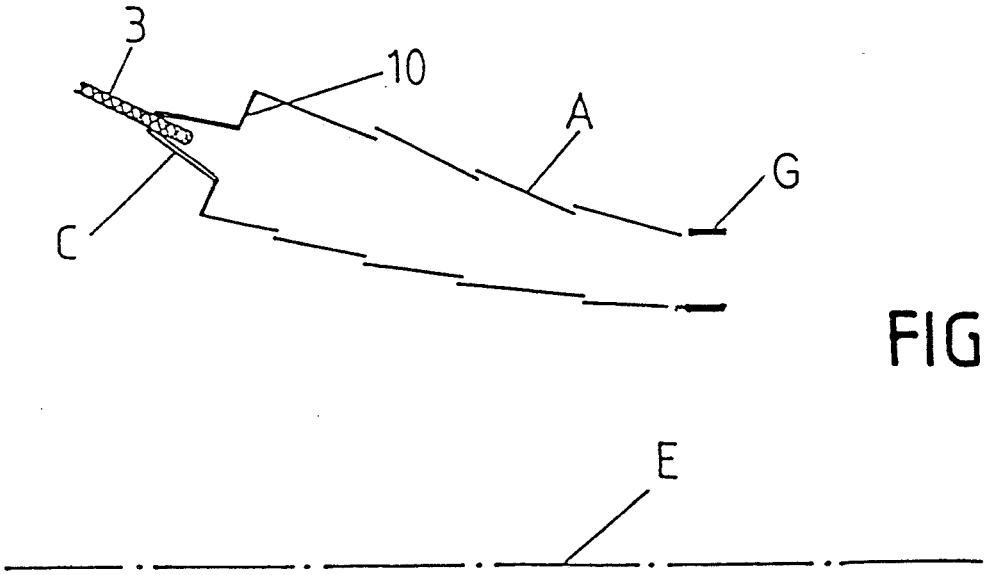
FIG. 3 shows a further section through an annular combustion chamber in the plane of a pilot burner.

FIGS. 2 and 3 show a diagrammatic section through an annular combustion chamber A, in the respective planes of a pilot burner C and a main burner B in each case. The annular combustion chamber A shown in these diagrams extends conically in the direction of the turbine inlet G, as is apparent from the center line E shown for the annular combustion chamber A. Each burner B, C, is associated with an individual nozzle 3. Even from this diagrammatic representation, it is possible to see that the burners B, C are both premixed burners, i.e. they can operate without the otherwise conventional premixing zone. These premixed burners B, C, must of course independent of their specific concept—be designed in such a way that there is no danger of burn-back into the premixing zone via the particular front panel 10. A premixed burner which meets this condition particularly well is comprehensively presented in FIGS. 6–9 and is explained in more detail there, it being possible for the construction of the two types of burner (main burner B/pilot burner C) to be the same—only their size being different. In an annular combustion chamber A of medium size, the size ratio between the main burner B and the pilot burner C is selected in such a way that approximately 23% of the burner air flows through the pilot burners C and approximately 77% through the main burners B.

Figure 4:
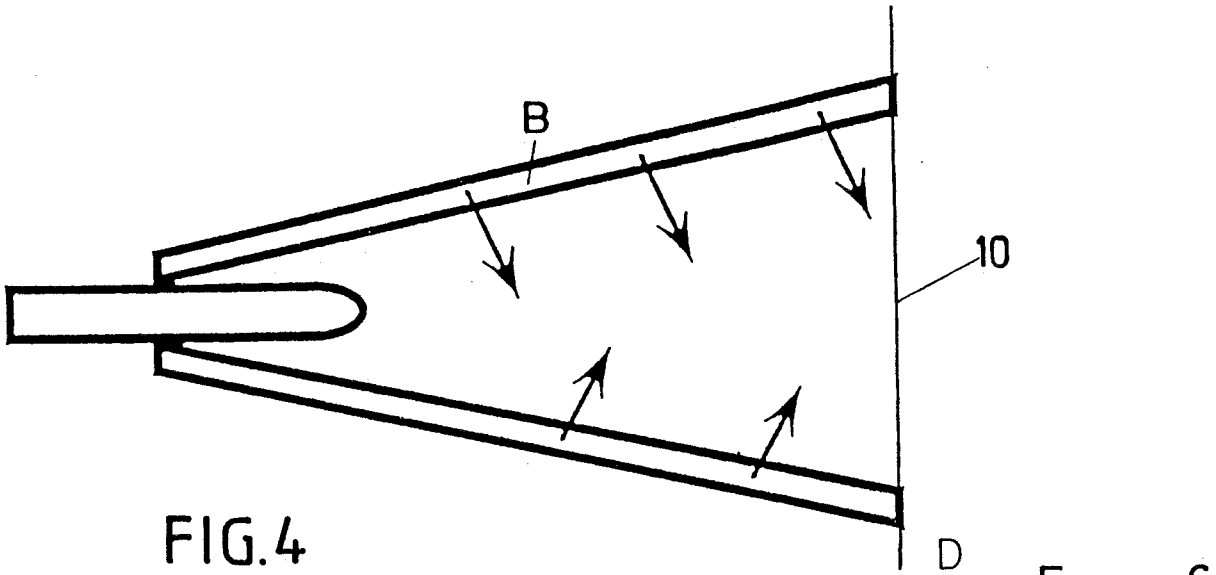
FIG. 4 shows a diagrammatic axial section through a burner.
Figure 5:
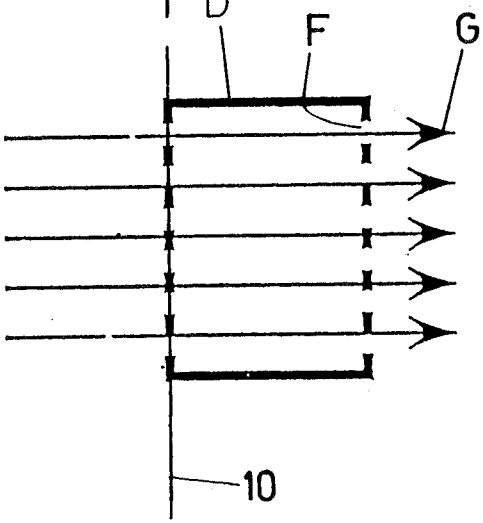
FIG. 5 shows a diagrammatic axial section in the region of the air nozzles.

FIGS. 4 and 5 show diagrammatically a main burner B, along section line IV—IV in FIG. 1, and the air nozzles F, along section line V—V in FIG. 1, as axial sections co-ordinated with respect to position. In this connection, it should be noted that the conduit D for the air nozzles F protrudes into the combustion space relative to front wall 10; this has the effect that the air G acts into the combustion space further downstream relative to the flame front of the burners B and C.

Figure 6:
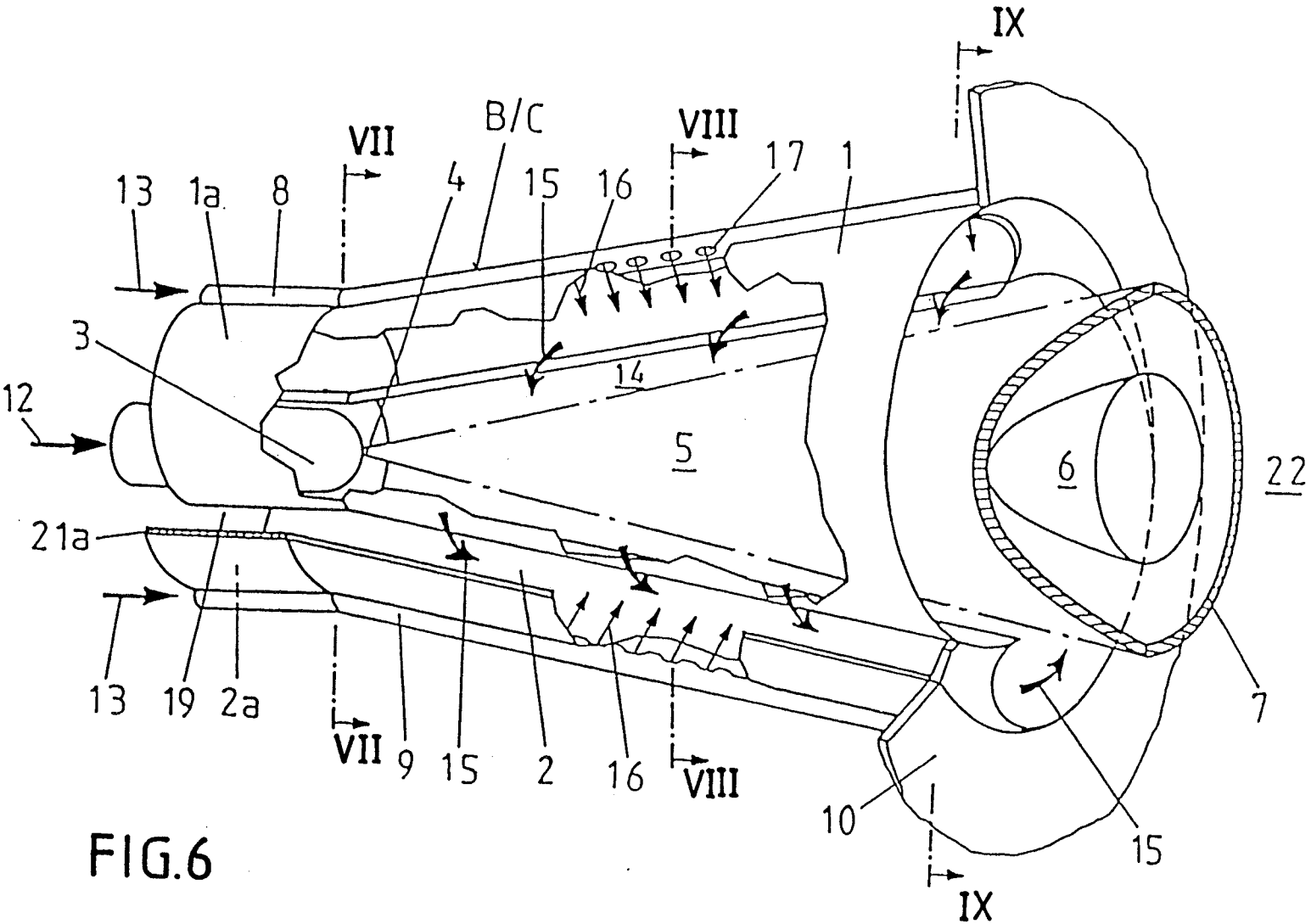
FIG. 6 shows a burner in the embodiment as double-cone burner, in perspective view and appropriately sectioned.
Figure 7:
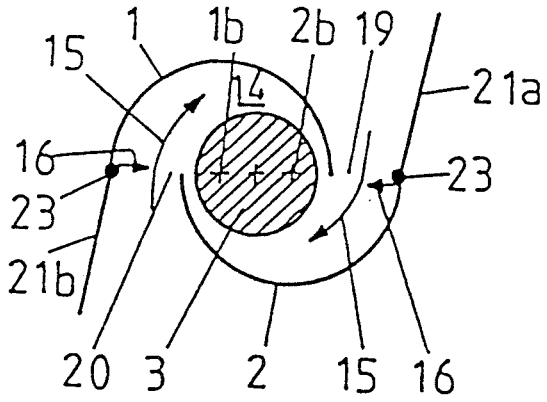
FIGS. 7, 8, 9 show corresponding sections through the planes VII—VII (FIG. 7), VIII—VIII (FIG. 8) and IX—IX (FIG. 9), these sections being only a diagrammatic, simplified representation of the double-cone burner of FIG. 6.
Figure 8:
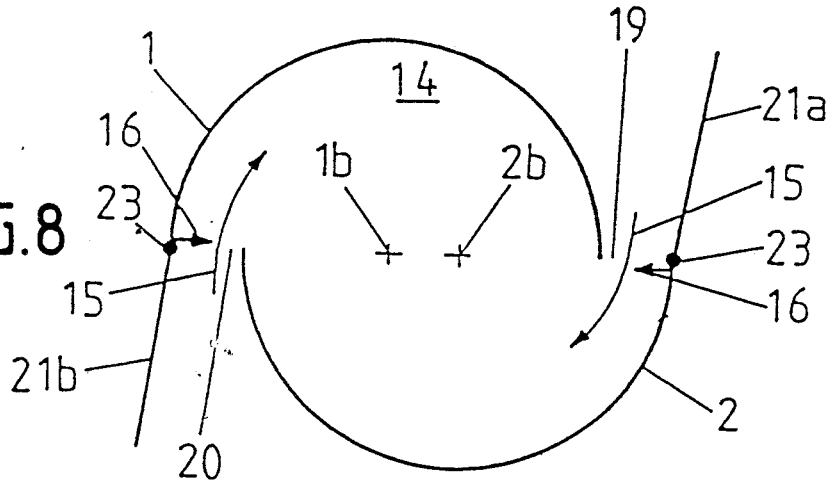
Figure 9:
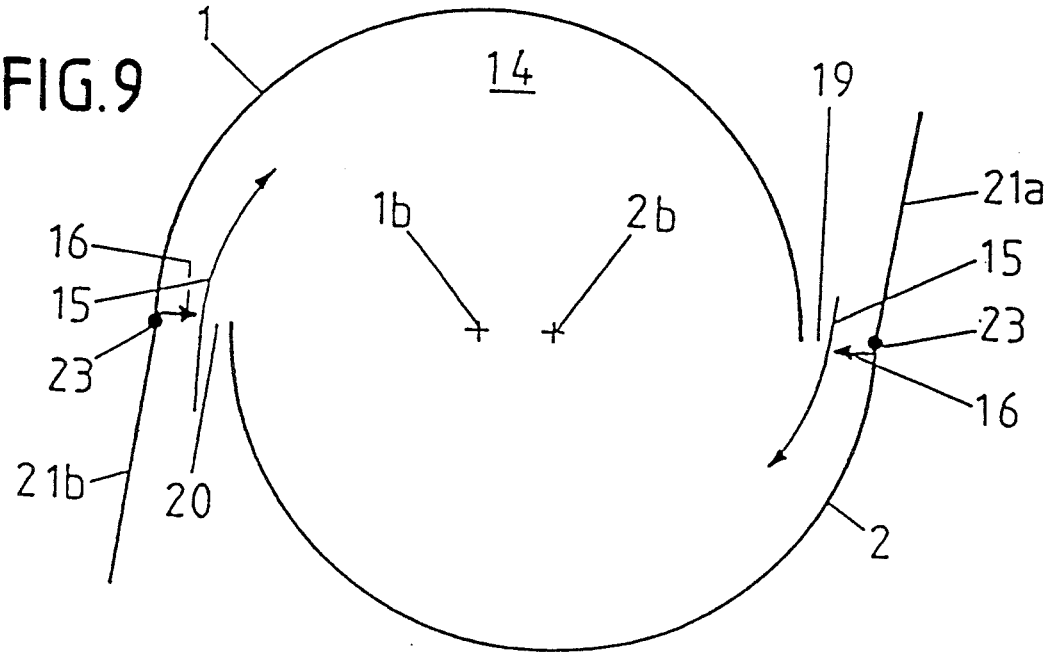

For better understanding of the construction of the burners B/C, it is advantageous to consider the individual sections of FIGS. 7–9 at the same time as FIG. 6. In addition, the guide plates 21*a*, 21*b* shown diagrammatically in FIGS. 7–9 are only indicated in FIG. 6 in order to avoid making the latter unnecessarily difficult to understand. In what follows, reference will be made to the residual FIGS. 7–9 as required even when describing FIG. 6.

The burner B/C of FIG. 6, which in terms of its structure can be either pilot burner C or main burner B, consists of two half hollow partial conical bodies, 1, 2, which are located one on the other but are offset relative to one another. The offset of the particular center lines 1*b*, 2*b* of the partial conical bodies 1, 2 relative to one another creates in each case a tangential air inlet slot 19, 20 on both sides in a mirror-image arrangement (FIGS. 7–9); the combustion air 15 flows through these slots into the internal space of the burner, i.e. into the conical hollow space 14. The two partial conical bodies, 1, 2 each have a cylindrical initial portion 1*a*, 2*a*, which portions also extend offset relative to one another in a manner analogous to the partial conical bodies 1, 2, so that the tangential air inlet slots 19, 20 are available from the beginning. A nozzle 3 is located in this cylindrical initial part 1*a*, 2*a* and its fuel spray inlet 4 coincides with the narrowest cross-section of the conical hollow space 14 formed by the two partial conical bodies 1, 2. The size of this nozzle 3, depends on the type of burner, i.e. on whether it is a pilot burner C or a main burner B. The burner can, of course, be designed to be purely conical, i.e. without cylindrical initial parts 1*a*, 2*a*. Both partial conical bodies 1, 2 each have a fuel duct 8, 9, which is provided with openings 17 through which the gaseous fuel 13 is added to the combustion air 15 flowing through the tangential air inlet slots 19, 20. The position of these fuel ducts 8, 9 is located at the end of the tangential air slots 19, 20 so that the mixing 16 of this fuel 13 with the entering combustion air 15 also takes place at this location. At the combustion space end 22, the burner B/C has a front wall (10) which forms the joint closure for all the premixing segments. The liquid fuel 12 flowing through the nozzle 3 is sprayed into the conical hollow space 14 at an acute angle in such a way that a conical fuel spray, which is as homogeneous as possible, forms at the burner outlet plane. The nozzle 3 can consist of an air-supported nozzle or a pressure atomizer. In certain types of operation of the combustion chamber, it is of course possible that it can also consist of a dual burner with gaseous and liquid fuel supply as is described, for example, in EP-Al 210 462. The conical liquid fuel profile 5 from nozzle 3 is enclosed by a tangentially entering rotating combustion air flow 15. In the axial direction, the concentration of the liquid fuel 12 is continuously reduced by the admixture of the combustion air 15. If gaseous fuel 13/16 is burned, the mixture formation with the combustion air 15 takes place directly at the end of the air inlet slots, 19, 20. In the case of a liquid fuel spray 12, the optimum, homogeneous fuel concentration across the cross-section is achieved in the region of the collapse of the vortex, i.e. in the region of the reverse flow zone 6. Ignition takes place at the tip of the reverse flow zone 6. It is only at this position that a stable flame front 7 can appear. Burn-back of the flame into the inner part of the burner (latently possible with known premixed sections and against which help is provided by complicated flame holders) does not have to be feared in the present case. If the combustion air 15 is preheated, natural evaporation of the liquid fuel 12 occurs before the point at the outlet of the burner, at which ignition of the mixture can occur, is reached. The degree of evaporation depends, of course, on the size of the burner, the droplet size distribution in the case of liquid fuel and the temperature of the combustion air 15. Independent, however, of whether—in addition to a homogeneous droplet mixture—partial or complete droplet evaporation is achieved by low temperature combustion air 15 or whether, in addition, it is achieved by preheated combustion air 15, the oxides of nitrogen and carbon monoxide emissions are found to be low if the air excess is at least 60%, thus making available an additional arrangement for reducing the $NO_x$ emissions. In the case of complete evaporation before entry into the combustion zone, the pollutant emission figures are at a minimum. The same also applies to operation near stoichiometric if the excess air is replaced by recirculating exhaust gas. In the design of the partial conical bodies 1, 2 with respect to cone inclination and the width of the tangential air inlet slots 19, 20, narrow limits have to be maintained so that the desired flow field of the air is achieved with its reverse flow zone 6 in the region of the burner outlet for flame stabilization purposes. In general, it may be stated that a reduction of the air inlet slots 19, 20 displaces the reverse flow zone 6 further upstream so that then, however, the mixture ignites earlier. It should, nevertheless, be noted that the reverse flow zone 6, once fixed geometrically, is inherently positionally stable because the swirl increases in the flow direction in the region of the conical shape of the burner. For a given installation length of the burner, the construction is extremely suitable for varying the size of the tangential air inlet slots 19, 20 because the partial conical bodies 1, 2 are fixed to the closure plate 10 by means of a releasable connection. The distance between the two center lines 1*b*, 2*b* is reduced or increased by radial displacement of the two partial conical bodies 1, 2 towards or away from one another and the gap size of the tangential air inlet slots 19, 20 alters correspondingly, as can be seen particularly well from FIGS. 7–9. The partial conical bodies 1, 2 can also, of course, be displaced relative to one another in a different plane and it is even possible to overlap them. It is, in fact, even possible to displace the partial conical bodies 1, 2 in a spiral manner relative to one another by means of opposite rotary motions. The possibility of arbitrarily varying the shape and size of the tangential air inlets 19, 20 so that the burner can be individually adapted without changing its installation length is therefore available.

The position of the guide plates 21*a*, 21*b* is apparent from FIGS. 7–9. They have flow inlet guide functions and, in accordance with their length, extend the relevant end of the partial conical bodies 1 and 2 in the inlet flow direction of the combustion air 15. The ducting of the combustion air into the conical hollow space 14 can be optimized by opening or closing the guide plates 21*a*, 21*b* about the center of rotation 23; this is particularly necessary when the original gap size of the tangential air inlet slots 19, 20 is changed. The burner can, of course, also be operated without guide plates.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United Sates is:

1. A combustion chamber of a gas turbine having a plurality of burners disposed on an inflow side of said chamber, each of said burners having at least one fuel feed, each of said burners being pre-mix burners and having an exhaust region where an exhaust gas vortex center is generated, said burners being disposed circumferentially side by side to one another in a manner such that said exhaust gas vortex center for each burner circulates in the same direction, said burners being disposed on an inlet wall of said combustion chamber such that said exhaust region of each of said burners terminates in a common plane, each of said burners being sized to provide a predetermined flow rate of a combustion air stream and positioned such that a small pre-mix burner is always disposed between two large pre-mix burners, said chamber further including nozzle means disposed in said chamber inlet wall for providing an additional air stream to provide stabilization of the exhaust vortex center of each burner, said nozzle means being disposed between each of said pre-mix burners and extending into said combustion chamber.

2. A combustion chamber as claimed in claim 10, wherein the large premix burners and the small premix burners are oriented such that the exhaust vortex center from each burner swirls in a same swirl direction.

3. Combustion chamber as claimed in claim 1, wherein the large premix burners are the main burners and the small premix burners are the pilot burners of the combustion chamber.

4. A combustion chamber as claimed in claim 1, wherein said air nozzle means inject air into a combustion space of the combustion chamber downstream of said common plane of said premix burners.

5. A combustion chamber as claimed in claim 1, wherein each premix burner includes at least two hollow conical bodies positioned on one another with increasing cone inclination in the flow direction, a centerline of each partial conical bodies extending offset to one another in a longitudinal direction, at least one fuel nozzle being placed at an inlet flow end in a hollow cone-shaped internal space formed by the partial conical bodies, a fuel spray inlet of said fuel nozzle being located between the mutually offset center lines of the partial conical bodies, the mutual offset of the center lines being a measure of the size of tangential air inlet slots disposed between the partial conical bodies.

6. A combustion chamber as claimed in claim 5, wherein the fuel nozzle can be operated with a liquid fuel.

7. A combustion chamber as claimed in claim 5, wherein further fuel nozzles are disposed in a region of the tangential inlet slots.

8. A combustion chamber as claimed in claim 7, wherein said further fuel nozzles can be operated with a gaseous fuel.

9. A combustion chamber as claimed in claim 1, wherein the combustion chamber is an annular combustion chamber having an annular front wall wherein the large premixed burners, the small premixed burners and the air nozzles emerge.

10. A combustion chamber of a gas turbine comprising:

an annular inlet flow end;

a plurality of premix burners positioned adjacent each other around a circumference of said inlet flow end, each of said burners having an exhaust region where an exhaust vortex center is generated;

said plurality of premix burners including large premix burners and small premix burners according to an amount of air directed through each of said burners;

said plurality of premix burners being positioned such that said exhaust vortex center of each burner circulates in the same direction;

each of said small premix burners being positioned between two of said large premix burners;

each of said large and small premix burners being disposed on an inlet wall of said annular inlet flow each such that said exhaust region of each of said large and small premix burners terminates in a common plane;

nozzle means for providing an air flow to a combustion space so as to stabilize the exhaust vortex center of each burner, said nozzle means be disposed between each of said plurality of premix burners;

each of said premix burners including at least two hollow part conical bodies positioned together to form a burner interior that has a cone inclination increasing in a flow direction, said bodies positioned together such that the center longitudinal axes of said bodies are offset from each other;

each of said premix burners having tangential air inlet slots for introducing combustion air into the interior of said burner body, said air inlet slots extending substantially the length of said burner body;

a nozzle for supplying a conical column of fuel within said burner body substantially along the length of said burner body, said nozzle having means for injecting fuel disposed at a location between said offset longitudinal axes of said part conical bodies.

* * * * *